United States Patent [19]

D'Andria

[11] 4,238,045

[45] Dec. 9, 1980

[54] LIP OPENABLE CLOSURE FOR CONTAINERS

[76] Inventor: Ernest F. D'Andria, P.O. Box 4487, Palm Springs, Calif. 92263

[21] Appl. No.: 70,254

[22] Filed: Aug. 27, 1979

[51] Int. Cl.[3] ..... A47G 19/22

[52] U.S. Cl. ..... 220/90.4; 220/254; 222/518

[58] Field of Search ..... 220/90.4, 254, 412, 220/420; 222/518, 508, 509, 511, 517; 128/222; D7/9, 10, 14

[56] References Cited

U.S. PATENT DOCUMENTS

| | | | |
|---|---|---|---|
| 3,338,467 | 8/1967 | Albert | 220/90.4 |
| 4,099,642 | 7/1978 | Nergard | 220/254 X |
| 4,138,033 | 2/1979 | Payne et al. | 220/90.4 X |

*Primary Examiner*—George T. Hall

*Attorney, Agent, or Firm*—Herzig & Walsh Incorporated

[57] ABSTRACT

A closure for containers adapted to be opened by the user's lips. A cap or cap body is provided which is a closure for the container, the cap body carrying a lip openable cap which includes a valve member cooperating with a seat formed within the cap body. The lip openable cap carrying the valve member is normally urged in closing direction by spring means integrally formed with it and constructed to seat against an annular shoulder formed in the container.

7 Claims, 4 Drawing Figures

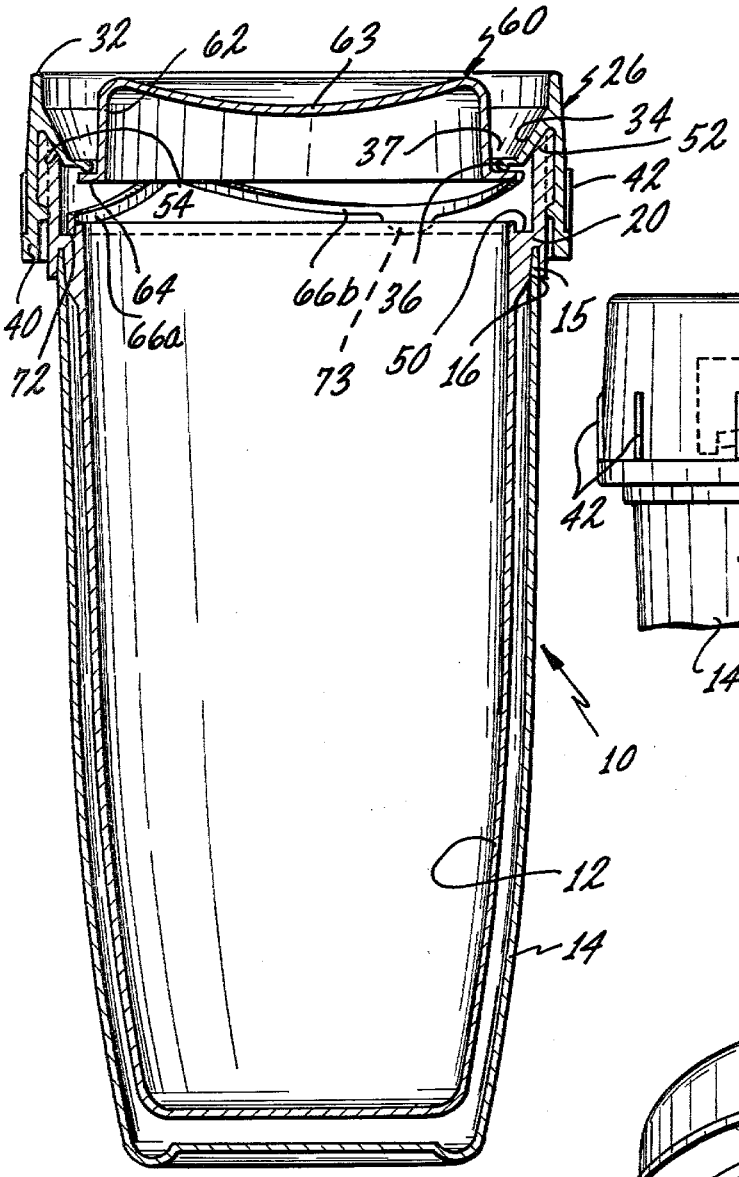
FIG. 1
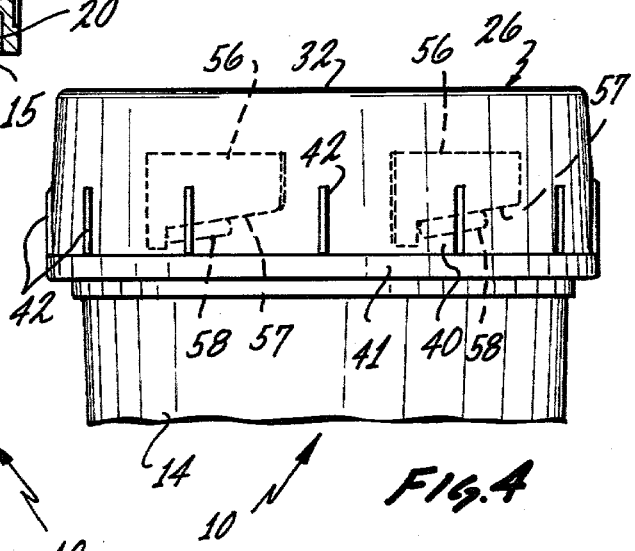
FIG. 4
FIG. 3
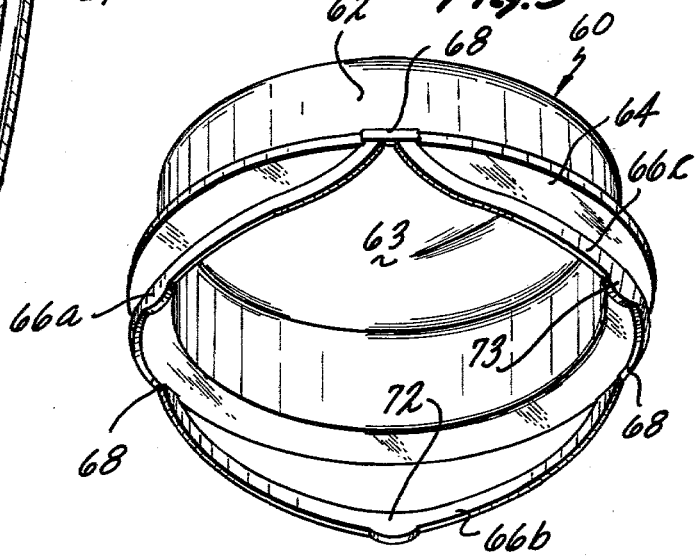

LIP OPENABLE CLOSURE FOR CONTAINERS

BACKGROUND OF THE INVENTION

1. Field of the Invention

The field of the invention is that of containers from which an individual may drink and more particularly such a container fitted with a type of cap cover which embodies a closure member openable by the lips of the user.

2. Description of the Prior Art

In the prior art efforts have been made to realize a type of container with a closure cap and closure member from which an individual could successfully drink by way of opening the closure member with the lips. To the best of knowledge of this inventor, the most relevant prior art is embodied in U.S. Pat. No. 3,338,467.

The prior art in this field has provided room for improvements residing principally in that of reducing the number of parts in the structure and providing for more simplified and economical fabrication of parts and assembly. The improvements are defined in detail in the hereafter specification.

SUMMARY OF THE INVENTION

In the preferred exemplary form of the invention as described in detail hereinafter it embodies a container which is preferably double walled. The upper part of the container which is preferably doubled walled. The upper part of the container is designed to receive a cap removably fitted to the container; the cap forming a closure member.

Provided within the cap or cap body is a lip openable cap member or closure member which embodies a valve that normally seats on a seat within the cap member and is openable by the user's lips. The cap body member at its upper end at its upper edge has a drinking edge. The user's lips are placed against the drinking edge; the user's lips operate the inner cap or closure member to open the valve to allow drinking from the drinking edge.

The inner cap or closure member embodying the valve is made integral with spring means which seat on an annular shoulder formed in the container itself.

A primary object of the invention is to realize improvements in an article as described, in which all of the advantages of prior art devices are present and additional significant advantages are realized by way of reduction of number of parts and simplification and ease of fabrication and assembly.

A further object is to realize an article as in the foregoing wherein the inner cap or closure member is constructed so that a biasing spring is formed integral with it as its lower part, this spring seating on a ledge in the container and normally holding the valve embodied in the cap body member closed.

Further objects and additional advantages will become apparent from the following detailed description and annexed drawings.

BRIEF DESCRIPTION OF THE DRAWINGS

FIG. 1 is a cross-sectional view of a preferred form of the invention;

FIG. 3 is a perspective view of the inner cap or closure member which forms a valve and is its integral spring part; and FIG. 4 is a partial external view of the upper part of the container with the cap in place.

DESCRIPTION OF THE PREFERRED EMBODIMENT AND PREFERRED MODE OF PRACTICE

Figure 2:
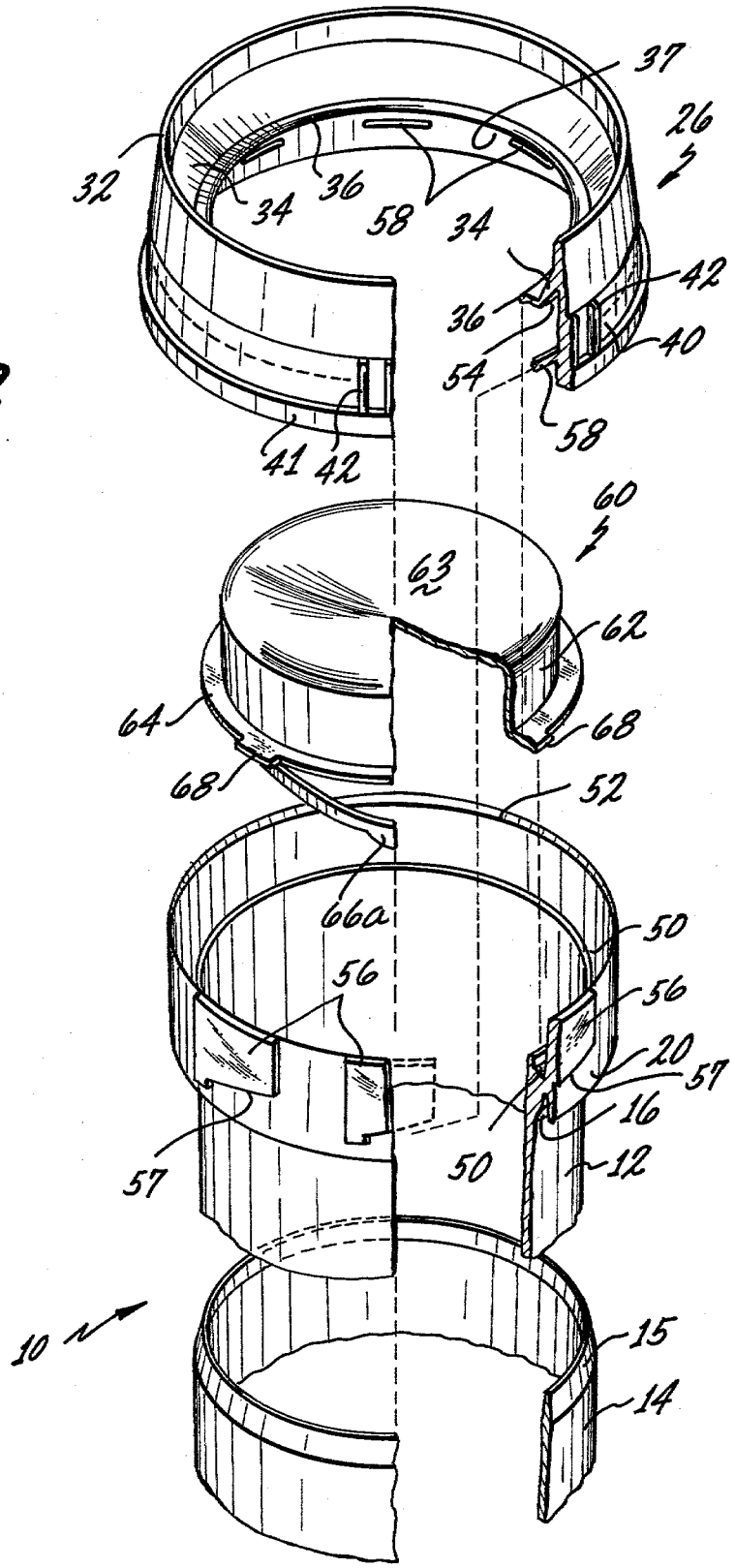
FIG. 2 is an exploded view in perspective of the part or components of the invention.

Referring to the various FIGS. of the drawings, numeral 10 designates the container itself, having an upper part configurated as may be seen in FIG. 2. The container itself as described thus forms an inner shell as designated at 12 and numeral 14 designates an outer shell, the upper end of which has a taper as designated at 15 that is received in an annular groove 16, facing downwardly in an upper enlarged part 20 of the container 10. The upper part 20 will be referred to again presently. The spaced shells provide an air space which serves as insulation to limit heat transfer.

Numeral 26 designates a cover or cap body that fits down over and attaches to the container. It has a rotating fit with the upper part 20 of the container and locks thereto and is removable by rotation, as will be described.

The configuration of the cover or body cap 26 may best be seen in FIGS. 1, 2, and 4. It is of ring shape and having an upper circular drinking edge 32. Extending from the upper part and inwardly is a web 34, the end of which as designated at 36 forms a valve seat which will be referred to again presently, the valve seat surrounding a circular valve opening.

The lower part of the cover or cap body forms a downwardly extending skirt as designated at 40, at the lower peripheral edge of which is a rib 41. Formed on the outside of the skirt 40 and above the rib 41 are parallel vertical ribs 42 to provide for manually grasping to rotate the cover or body cap.

The valve seat 36 on the inside of the cover is at the end of a downwardly slanted web 34 as described.

The inner shell 12 has an enlarged upper part 20 as previously described and which fits within the lower skirt part 40 of the closure or body cap 32 as shown. The inner shell 12 at the upper part at the juncture of the enlarged part 20 is configurated to form an annular groove or a shoulder 50 which will be described presently. The upper part of the enlarged part is tapered as shown at 52 and is received in the opening between the tapered part 34 and the sidewall or skirt 40 of the cover or body cap 26 as designated by the numeral 54 in FIG. 2.

On the outside of the enlarged part 20 of the inner shell 12 are formed a plurality of wedge members as designated at 56 which are positioned against the surface of the portion 20, these pieces having slanting or wedged shaped lower edges as designated at 57. A plurality of the members are provided which form detent members which cooperate with angular ribs such as shown at 58 in FIG. 2.

The cover 26 can be placed down over the top enlarged part 20 of the container with the ribs 58 passing in between the members 56 which are detent members, and then by turning the cover part 26, the detent members 58 can be brought under the curved edges 57 to lock these parts in place.

Referring to FIGS. 2 and 3, numeral 60 designates the lip openable valve member. It is primarily cylindrical, having sidewalls 62 and a depressed or concave upper surface 63 as shown. At the lower edge of the circumferencial sidewall 62 is a flange part 64 forming a valve member which cooperates with the valve seat, as previously described, seating when moved upwardly against the valve seat 36.

Integrally formed with the valve member 60 are spring biasing means. The spring biasing means are formed by integral web members identified by the numeral 66*a*, 66*b* and 66*c*, having a configuration as shown in FIG. 3. There are three of these web members equiangularly arranged. The ends of the web members are joined with projections such as shown at 68 on the valve seat 64 at three positions. Each of the web members 66 has an abutment formed on it, two of which may be seen at 72 and 73 in FIG. 3 and in FIG. 1 and these abutments seat in the annular shoulder or groove 50 as previously described in the upper part of the inner shell 12.

FIG. 2 illustrates the structure of each of the components and FIG. 1 illustrates the assembled relationship, FIG. 3 illustrating the lip-openable valve in perspective.

With respect to usage of the article, FIG. 1 shows a position in which the lip-openable valve member is seated so that contents of the article, that is the container, would not run out. The integral spring construction on the valve member 60 is seated in the annular groove 50. In usage, when the user's lips are placed against the drinking edge 32, the openable valve member can be actuated by the user's lip to open the valve, that is to depress the member 60 downwardly against the integral spring structure so as to open the valve 64 at one side to allow liquid to enter up into the open end of the cover or body cap 26 for drinking from edge 32.

From the foregoing those skilled in the art will readily understand the nature and construction of the invention, and how the improvements and objects as set forth in the foregoing are realized. All of the advantages of prior art structures are retained while superiority is achieved from the standpoint of minimization of parts and simplification and ease of fabrication and assembly. The valve member and resilient means are an integral part. The parts are formed for ease of production such as by plastic injection molding.

The foregoing disclosure is representative of a preferred form of the invention and is to be interpreted in an illustrative rather than a limiting sense, the invention to be accorded the full scope of the claims appended hereto.

I claim:

1. In combination with a container for liquids, a lip-openable closure cap body for the container adapted to fit an annular open end of the liquid container, the said cap body having an open end provided with an annular drinking edge, a lip-openable cap, positioned internally of the cap body, said cap body having a valve seat, the lip-openable cap having part forming a valve member cooperable with said seat and including integrally formed resilient means, means providing an annular ledge, the said resilient means resting against said ledge and normally urging the lip-openable cap to seat against the valve seat, said lip-openable cap being positioned whereby a user's lips may engage the openable cap for purpose of unseating it from its seat to allow liquid to pass through the valve seat into the upper interior part of the cap body for drinking from the drinking edge, the cap body being constructed to hold liquid to be drunk.

2. An article as in claim 1 wherein the said cap body is constructed to fit around the upper end of the said container, said resilient means being within the upper end of the container which is within the said body cap.

3. In combination with a container for liquids, a lip-openable closure cap body for the container adapted to fit an annular open end of the liquid container, the said cap body having an open end provided with an annular drinking edge, a lip-openable cap, positioned internally of the cap body, said cap body having a valve seat, the lip-openable cap including integrally formed resilient means, means providing an annular ledge, the said resilient means resting against said ledge and normally urging the lip-openable cap to seat against the valve seat, said lip-openable cap being positioned whereby a user's lips may engage the openable cap for purposes of unseating it from its seat to allow liquid to pass through the valve seat into the upper interior part of the cap body for drinking from the drinking edge, said cap body being constructed to fit over the upper part of the container having a part upon which said flexible means seats.

4. In combination with a container for liquids, a lip-openable closure cap body for the container adapted to fit an annular open end of the liquid container, the said cap body having an open end provided with an annular drinking edge, a lip-openable cap, positioned internally of the cap body, said cap body having a valve seat, the lip-openable cap including integrally formed resilient means, means providing an annular ledge, the said resilient means resting against said ledge and normally urging the lip openable cap to seat against the valve seat, said lip-openable cap being positioned whereby a user's lips may engage the openable cap for purposes of unseating it from its seat to allow liquid to pass through the valve seat into the upper interior part of the cap body for drinking from the drinking edge, the said container being of double walled construction, the container having an outer shell, having an upper edge, the said container having an upper enlarged part having an annular groove configurated to receive the upper edge of the outer shell.

5. In combination with a container for liquids, a lip-openable closure cap body for the container adapted to fit an annular open end of the liquid container, the said cap body having an open end provided with an annular drinking edge, a lip-openable cap, positioned internally of the cap body, said cap body having a valve seat, the lip-openable cap including integrally formed resilient means, means providing an annular ledge, the said resilient means resting against said ledge and normally urging the lip openable cap to seat against the valve seat, said lip-openable cap being positioned whereby a user's lips may engage the openable cap for purposes of unseating it from its seat to allow liquid to pass through the valve seat into the upper interior part of the cap body for drinking from the drinking edge, said lip-openable cap being of cylindrical configuration, the said resilient means being in the forming of resilient webs having end parts integral with said cap and having abutments engageable with said ledge.

6. An article as in claim 1 wherein the annular ledge is provided by a top edge of the container.

7. An article as in claim 5 wherein said cap is of inverted cup shape, its side walls having an outwardly extending flange forming the said valve part, said webs extending from said flange.

* * * * *